US005892189A

United States Patent [19]

Wang

[11] Patent Number: 5,892,189

[45] Date of Patent: Apr. 6, 1999

[54] APPARATUS AND METHOD FOR DETERMINING MESSAGES TRANSMISSION PERIOD IN AN ELEVATOR GROUP CONTROL SYSTEM

[75] Inventor: Kwang Sig Wang, Kyongsangnam-Do, Rep. of Korea

[73] Assignee: LG Industrial Systems Co., Ltd., Seoul, Rep. of Korea

[21] Appl. No.: 953,439

[22] Filed: Oct. 17, 1997

[30] Foreign Application Priority Data

Oct. 17, 1996 [KR] Rep. of Korea ..... 1996-46447

[51] Int. Cl.[6] ..... B66B 1/28; B66B 1/34

[52] U.S. Cl. ..... 187/247; 187/391

[58] Field of Search ..... 187/247, 248, 187/382, 386, 391, 393

[56] References Cited

U.S. PATENT DOCUMENTS 4,497,391 2/1985 Mendelsohn et al. ..... 187/380

4,700,810 10/1987 Otala ..... 187/247

4,872,532 10/1989 Tobita et al. ..... 187/391

5,360,952 11/1994 Brajczewski et al. ..... 187/247

*Primary Examiner*—Robert E. Nappi

[57] ABSTRACT

The present invention relates to a method for transmitting messages in an elevator group control apparatus wherein a plurality of elevator controllers and a separate group controller transmit data using a covalent bus line. The invention comprises the steps of (a) transmitting, through the serial communication bus line, a data transmission period and a data transmission star point of each elevator controller, which are determined in accordance with the number of elevator cars connected with the serial communication bus line by the group controller, to the corresponding elevator controller; and (b) receiving the data transmission period and the start point which are transmitted through the serial communication line from the group controller; and (c) storing the data transmission period.

8 Claims, 7 Drawing Sheets

Fig. 8
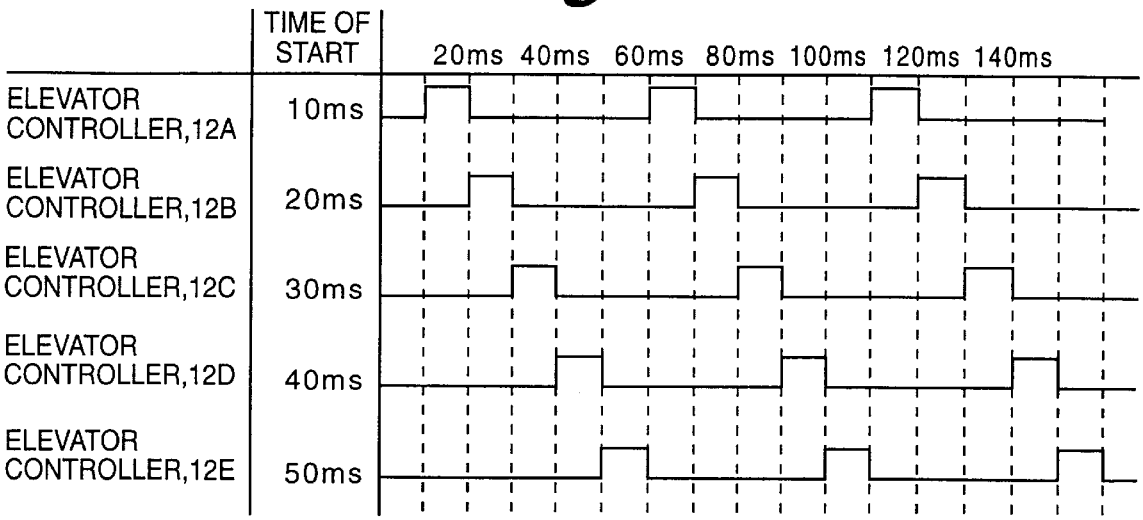
Fig. 9
| SET OF BIT FOR GROUP CONTROL ASSOCIATION | PERIOD VALUE OF DATA TRANSMISSION |
|---|---|
Fig. 10
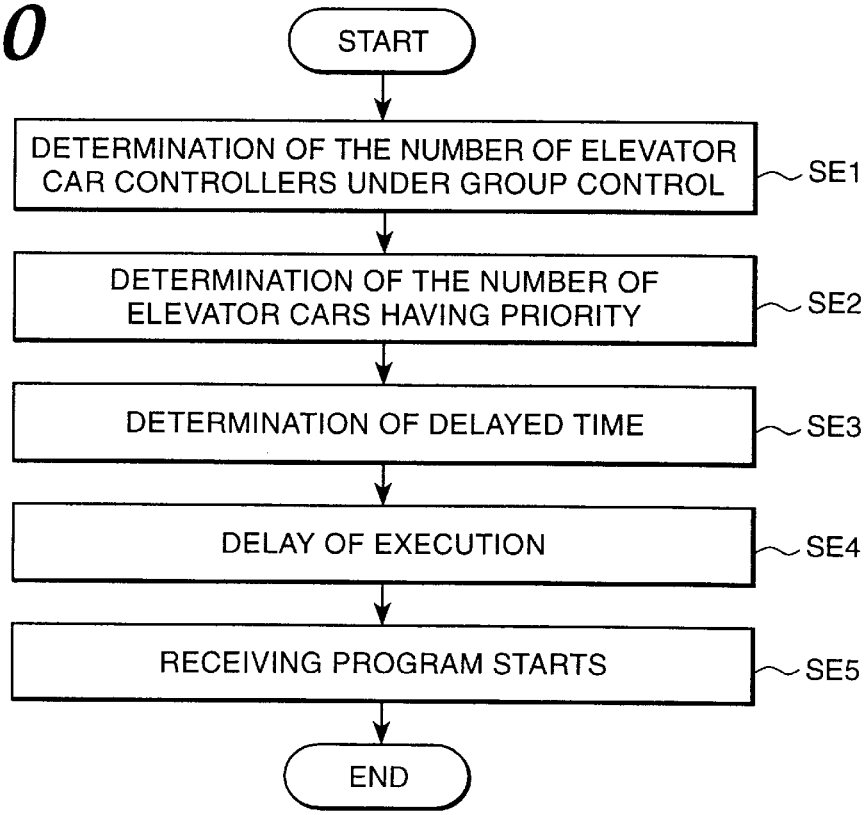

APPARATUS AND METHOD FOR DETERMINING MESSAGES TRANSMISSION PERIOD IN AN ELEVATOR GROUP CONTROL SYSTEM

CROSS REFERENCE TO RELATED APPLICATION

This application claims priority from Korean Patent Application No. P96-46447, filed on Oct. 17, 1997, which is hereby incorporated by reference in its entirety.

BACKGROUND OF THE INVENTION

1. Field of the Invention

The present invention relates to an apparatus and a method for determining a messages transmission period in an elevator group control system which includes a plurality of elevator controllers, a separate group controller and a serial communication bus line connecting the plurality of elevator controllers with the group controller, so that a load on a communication line is reduced and a data transmitting speed is improved when the messages are transmitted between the elevator controllers and the group controller.

2. Description of the Conventional Technology

In the elevator group control system, generally, the group controller and the elevator controllers are connected in 1:1 parallel fashion to perform serial communications. Thus, the load on the communication line is not heavily burdened when there are a large number of elevator controllers.

However, as each elevator controller is connected with the group controller through each exclusive cable, this kind of communication system has the problem that the number of cable in the communication line are too many. Under the circumstances, it has been disclosed a serial communication system wherein a plurality of elevator controllers are associated with the group controller through a serial communication bus line. However, in a case of using the serial communication bus line, the load on the communication line is apt to be heavily burdened when data are transmitted at once from each elevator controller.

Moreover, in the conventional group controller, the data transmission period of the elevator controller is fixedly determined without consideration of the number of elevator controllers connected thereto. Namely, if the time it takes for one of the elevator controllers to use the serial communication bus line is determined as 10 ms in a predetermined period and eight elevator cars can be associated with the group controller through the serial communication bus line, the time assigned to the whole elevator controllers is 80 ms. If the number of elevator cars associated with the group controller is four, the data transmission is performed during 40 ms among the predetermined total time (80 ms) that the elevator controllers are able to use the serial communication bus line assigned thereto. Therefore, this causes a problem of a non-efficiency by spending a time of 40 ms. Such a conventional technology will be explained below:

FIG. 1 shows a block diagram illustrating the whole constitution of a conventional group controller of an elevator car. As shown in FIG. 1, the conventional group controller includes an operation controlling section 11A for sensing an occurrence of failure in an elevator controller and for controlling specific operations; a statistics processing section 11B for collecting and arranging various statistics data to evaluate operation conditions of a group controller 11; a traffic information analyzing section 11C for collecting the present data to predict a communication load to the communication signals in the process that the group controller 11 assigns an optimal elevator car, and storing the data in a traffic information data base 11D; a hall call registration table 11E for storing hall button input signals created in each elevator landing floor; a hall call assignment table 11F for storing the optimal elevator car assigned by the group controller 11 in response to the input hall call; a hall call assignment section 11G for assigning an optimal control operation in response to the corresponding hall call by checking the operation conditions of each of elevator controllers 12A–12K when a hall call is created, and on the basis of the determination results, assigning the optimal elevator car to the created hall call; a data receiving section 11H and a data transmitting section 11I for performing the data communication; and a data accumulating section 13 for collecting the data transmitted from a number of the elevator controllers 12A–12K and transmitting them to the data receiving section 11H through the serial communication bus line, and transmitting the data provided through the data transmitting section 11I to the corresponding landing floor controllers 14A–14M and 15A–15M.

The operation of the conventional group controller as disclosed above will be explained with reference to FIGS. 1 to 3 as follows.

The transmitted data created from each of the elevator controllers 12A–12K are received through a routine as shown in FIG. 2. If a user selects an operation bottom for an elevator car and power is supplied into each of the elevator controllers 12A–12K, an initialization is executed and then an operability of an elevator controller is discriminated in test SA1. If the elevator controller is in a normal condition, the memory in the elevator controller is initialized. That is, the necessary functions are executed such as clearing the memory of RAM, transmitting the data stored in ROM into RAM, and assigning addresses. Thereafter, the programs required for elevator controllers are started and the data transmitting/receiving programs are also started so that the data created from the elevator controllers can be transmitted to the group controller.

In the elevator controllers 12A–12K connected with the group controller 11, the intervals in which the data transmitting/receiving programs are started, are not constant since all of their operation conditions cannot be recognized. This is because the time for users to supply the elevator controller with the power is the point which the data transmitting/receiving programs of the elevator controllers are started. These conditions will be explained referring to the drawings as follows:

FIG. 3 shows a timing diagram for transmitting the messages created from each of the elevator controllers according to the conventional technology.

In FIG. 3, regarding a time at which a data transmission program starts, if the first elevator controller 12A starts after 5 ms from an optical start time; the second elevator controller 12B after 10 ms; the third elevator controller 12C after 15 ms; the fourth elevator controller 12D after 20 ms; and the fifth elevator controller 12E after 30 ms, respectively, and if the data transmission period is determined as 50 ms in each of elevator controllers 12A–12K, the data transmitted from the third elevator controller 12C at a point of 17 ms is delayed since the second elevator controller 12B has already occupied the serial communication bus line.

Herein, the period in which the data transmission program starts in elevator controllers 12A–12K, that is, data transmission period of 50 ms is the minimum period in which the group controller has to receive the information for operation conditions of the elevator car from each of elevator controllers 12A–12K in order to successfully perform the whole elevator control. Namely, in order that the group controller 11 can complete a successful performance of the group operation, the data should be received within 50 ms from all elevator controllers 12A–12K.

The data transmission period in each of elevator controllers 12A–12K is the fixed value to be predetermined in the program. As the data transmission period has the fixed value of 50 ms, which is designated by the user, in case that the number of elevator controllers associated with the group controller 11 is four and that each of elevator controllers 12A–12K transmits data for 10 ms, it will take only 40 ms to use the serial communication line assigned to the elevator controller.

In such a manner, there is the problem that the communication line becomes heavily burdened by transmitting the data to the serial communication bus line nearly at the same time since the communication method between the conventional group controller and elevator controllers is determined by the period in which the data transmission programs of elevator controllers start, that is, the time that the data transmission programs supply the elevator controllers with power.

Further, the data transmission period of each elevator controller (i.e. the period in which each elevator controller uses the serial communication bus line) is predetermined on the program without consideration of the number of elevator controllers connected to the serial communication bus line. Consequently, if the number of elevator cars is determined under a maximum value of number which can be associated, there is the problem of non-efficiency in the communication line such that time-wise, the optimal operation of the serial communication line by the elevator controllers is not achieved.

SUMMARY OF THE INVENTION

Accordingly, an object of the present invention is to solve the above-indicated problems in order that a large load on the communication line does not occur when data are transmitted from the elevator controllers, by providing an apparatus and a method for determining a messages transmission period in an elevator group control system, wherein the group controller determines the data transmission point with respect to each of elevator controllers to prevent a data transmission of each elevator controller from being delayed on the covalent serial communication bus line; and wherein a data transmission period of each elevator controller is variably determined according to the number of elevator controllers associated with the covalent serial communication bus line to improve efficiency of using the serial communication line.

In order to achieve the above object, the present invention provides an apparatus for determining a messages transmission period in an elevator group control system, which comprising: An apparatus for determining a messages transmission period in an elevator group control system which includes a plurality of elevator controllers of which are each installed to correspond to each of elevator cars to control an operation of each elevator car, a group controller to receive an information data of operation conditions of the elevator cars from said elevator controllers and to generally control the operations of said elevator controllers in accordance with the received information data, and a covalent serial bus line which is linked with said elevator controllers to connect with said group controller, comprising: a first means for determining the maximum number of elevator controllers which can be associated with the group controller at a maximum; a first memory means for storing data of the maximum number of connectable elevator controllers determined by said first means; a second means for determining the number of elevator cars to be generally controlled by the group controller; a second memory means for storing data of the number of elevator cars to be group-controlled, which are determined by said second means; a third means for determining a minimum period in which data of operation conditions are received from all elevator controllers periodically controlled by the group controller for a perfable general control; a third memory means for storing data of said minimum period in which data are received, and which are determined by said third means; a first computing means for computing a transmission period value and outputting a resulting value obtained by a data transmission period T (i.e., $T=Y/X'\times X$), wherein X' is a value of the maximum number of connectable elevator controllers, X is a value of the number of elevator controllers to be group-controlled, and Y is a value of the minimum period in which data are received, said first process means being connected with said first, second and third memory means from which X', X and Y are read, respectively; a second computing means for computing and outputting a delayed time in transmitting the transmission period value by dividing the value of the minimum period in which data are received by the value of the number of elevator cars to be group-controlled, said second computing means being connected with said second and third memory means, and the value of the number of elevator controllers to be group-controlled and the value of the minimum period being read therefrom, respectively; a transmission delay time counter for outputting output signals when a delayed time is passed, by counting the transmission delay time received from said second computing means; a generation and output means for generating and outputing an elevator controller number whenever said transmission delay time counter outputs singals; a first data receiving/transmitting section for transmitting, through the serial communication bus line, the value of the transmission period which is outputted from said first computing means and the elevator controller number from said generation means to the elevator controllers when said transmission delay time counter outputs signals; and a counter for counting the number of transmission times of the transmission period value and for outputting a transmission stop signal to said first data receiving/transmitting section if the number of transmission times transmitted from said first data receiving/transmitting section is the same as the number of elevator controllers to be group controlled transmitted from said second memory means, said counter being connected with said first data receiving/transmitting section and said second memory means;

wherein each elevator controller comprises: a second data receiving/transmitting section for receiving the transmission period value; and a fourth memory means for storing the received transmission period value.

In order to achieve the another object, the present invention provides a method for determining a transmission period in an elevator group control system, which comprising the steps of:(a) transmitting, through the serial communication bus line, a data transmission period and a data transmission starting time of each elevator controller, which are determined in accordance with the number of elevator cars connected with the serial communication bus line by the group controller, to the corresponding elevator controller; (b) receiving the data transmission period and the start point which are transmitted through the serial communication line from the group controller; and (c) storing the data transmission period.

BRIEF DESCRIPTION OF THE DRAWINGS

Other objects, features and advantages of the present invention will become more apparent from the technology of a preferable embodiment described with reference to the drawings, in which:

FIG. 8 is a timing diagram of the data transmission period of an elevator controller according to the present invention.

FIG. 9 is a table showing transmission data formats of the data transmission period from the group controller, according to a second embodiment of the present invention.

FIG. 10 is a flow chart showing the processes of determining the data transmission period in an elevator controller and starting the data transmission, according to the second embodiment of the present invention.

DETAILED DESCRIPTION OF THE PREFERRED EMBODIMENT

Hereinafter, referring to FIGS. 4 through 10, the constitutions, actions and effects of the present invention will be explained.

Figure 4A:
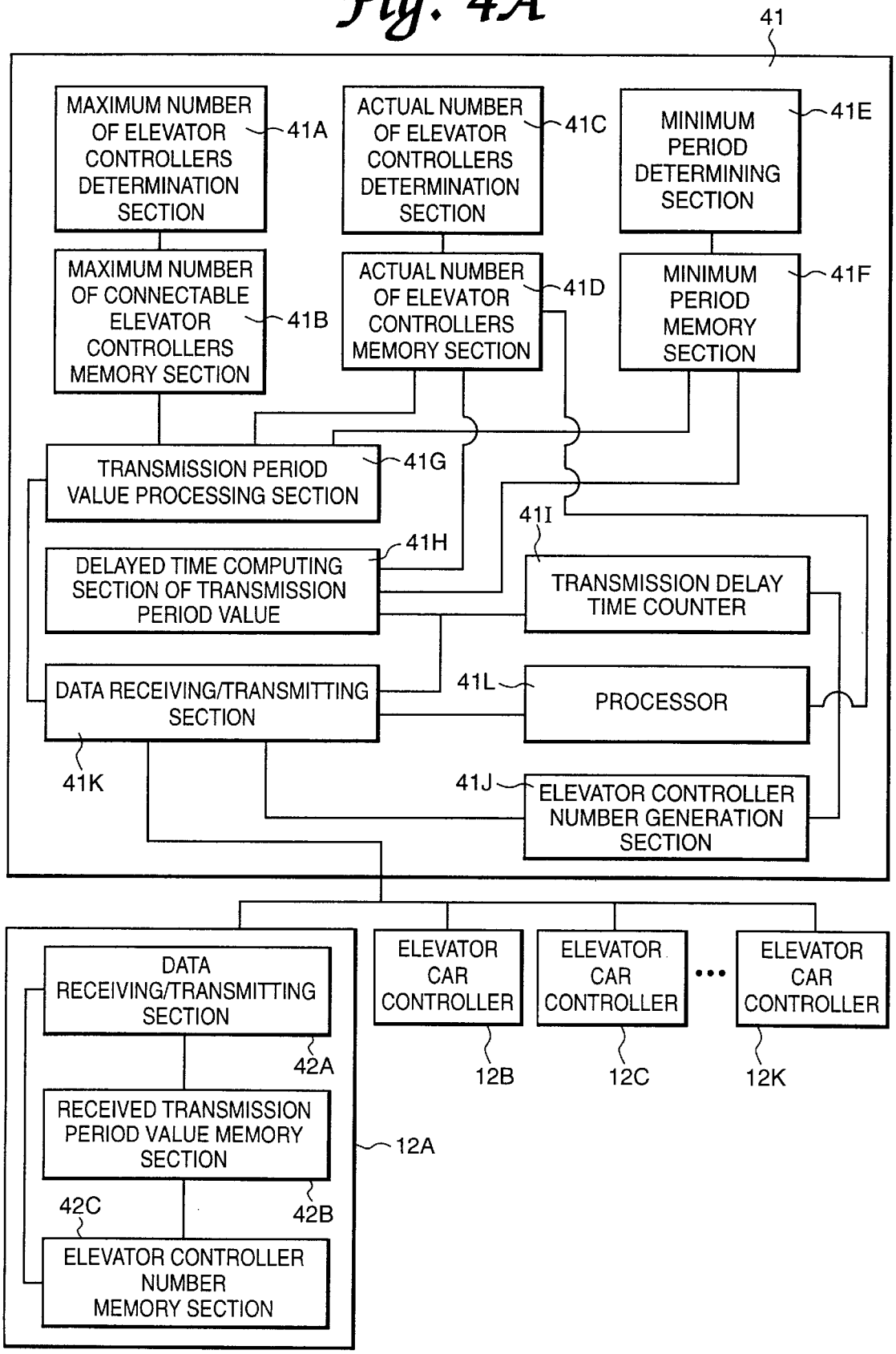
FIGS. 4A and 4B are block diagrams for a constitution of a group controller to which the present invention is applied.
Figure 4B:
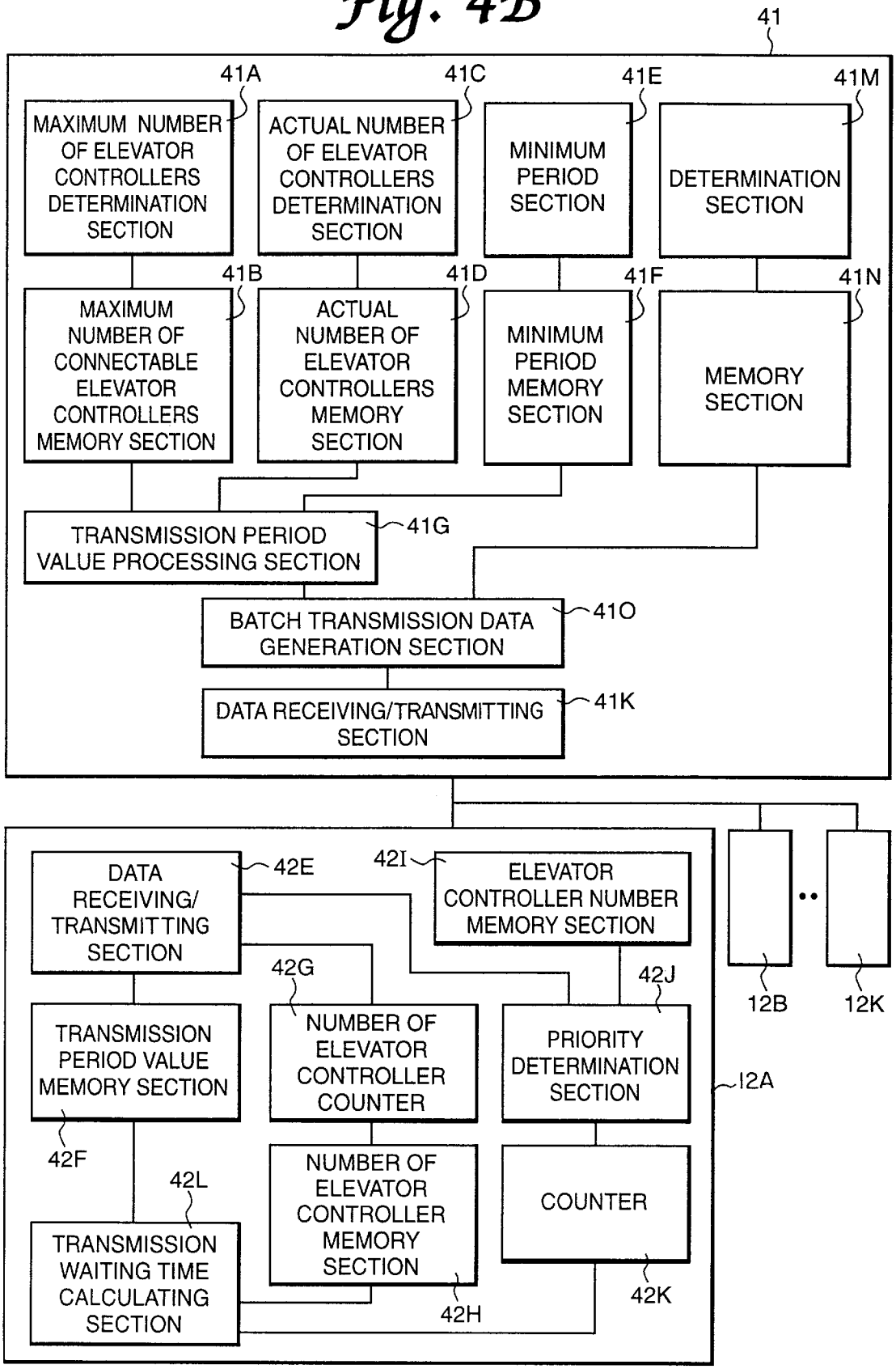

FIGS. 4A and 4B are block diagrams illustrating a constitution of an elevator group control; system to which the present invention is applied. As shown in FIG. 4A, an elevator control system includes a maximum number of elevator controllers determination section 41A for determining the maximum number of elevator controllers 12A–12K which can be associated with the group controller 41 at a maximum; a maximum number of connectable elevator controllers memory section 41B for storing data of the maximum number of connectable elevator controllers determined by the maximum number of elevator controllers determination section 41A; a number of elevator controllers determination section 41C for determining the number of elevator cars to be controlled by the group controller; a number of elevator controllers memory section 41D for storing data of the number of elevator controllers to be group-controlled, which are determined by the number of elevator controllers determination section 41C; a minimum period section 41E for determining a minimum period in which data of operation conditions are received from all elevator controllers periodically controlled by the group controller for a perfable general control; a minimum period memory section 41F for storing data of the minimum period in which data are received, and which are determined by the minimum period section 41E; a transmission period value processing section 41G for processing a transmission period value and outputting a resulting value obtained by a data transmission period T (i.e., $T=Y/X'\times X$), wherein X' is a value of the maximum number of connectable elevator controllers, X is a value of the number of elevator controllers to be group-controlled, and Y is a value of the minimum period in which data are received, the transmission period value processing section 41G being connected with the maximum number of connectable elevator controllers memory section 41B, the number of elevator controllers memory section 41D, and the minimum period memory section 41F from which X', X and Y are read, respectively; a delayed time computing section of transmission period value 41H for combuting and outputting a delayed time in transmitting the transmission period value by dividing the value of the minimum period in which data are received by the value of the number of elevator controllers to be group-controlled, the delayed time processing section of transmission period value 41H being connected with the number of elevator controllers memory section 41D and the minimum period memory section 41F, and the value of the number of elevator controllers to be group-controlled and the value of the minimum period being read therefrom, respectively; a transmission delay time counter 41I for outputting output signals when a delayed time is passed, by counting the transmission delay time received from the delayed time processing section of transmission period value 41H; an elevator controller number generation section 41J for generating an elevator car number whenever the transmission delay time counter 41I outputs signals; a data receiving/transmitting section 41K for transmitting, through the serial communication bus line, the value of the transmission period which is outputted from the transmission period value processing section 41G and the elevator car number from the elevator car number generation section 41J to the elevator controllers when the transmission delay time counter 41I outputs signals; and a processor 41L for processing the number of transmission times of the transmission period value and for outputting a transmission stop signal to first data receiving/transmitting section 41K if the transmission period value transmitted from the data receiving/transmitting section 41K is the same as the number of elevator controllers to be group controlled transmitted from the number of elevator controllers memory section 41D, the processor 41L being connected with the data receiving/transmitting section 41K and the number of elevator controllers memory section 41D.

Each elevator controller 12A–12K includes a data receiving/transmitting section 42A for receiving the transmission period value; and a received transmission period value memory section 42B for storing the received transmission period value.

Further, as shown in FIG. 4B, an elevator control system includes a maximum number of elevator controllers determination section 41A for determining the maximum number of elevator controllers 12A–12K which can be associated with the group controller 41 at a maximum; a maximum number of connectable elevator controllers memory section 41B for storing data of the maximum number of connectable elevator controllers determined by the maximum number of elevator controllers determination section 41A; a number of elevator controllers determination section 41C for determining the number of elevator controllers to be generally controlled by the group controller; a number of elevator controllers memory section 41D for storing data of the number of elevator controllers to be group-controlled, which are determined by the number of elevator controllers determination section 41C; a minimum period section 41E for determining a minimum period in which data of operation conditions are received from all elevator controllers periodically controlled by the group controller for a perfable general control; a minimum period memory section 41F for storing data of the minimum period in which data are received, and which are determined by the minimum period section 41E; a transmission period value processing section 41G for processing a transmission period value and outputting a resulting value obtained by a data transmission period T (i.e., T=Y/X'×X), wherein X' is a value of the maximum number of connectable elevator controllers, X is a value of the number of elevator controllers to be group-controlled, and Y is a value of the minimum period in which data are received, the transmission period value computing section 41G being connected with the maximum number of connectable elevator controllers memory section 41B, the number of elevator controllers memory section 41D, and the minimum period memory section 41F from which X', X and Y are read, respectively; a determination section 41M for determining whether elevator controllers or elevator cars to be group-controlled; a memory section 41N for storing the data determined by the determination section 41M;

a batch transmission data generation section 41O for aligning in sequence data of elevator controllers or elevator cars to be group-controlled in the order of increasing numbers thereof, and for outputting a set of the data to be transmitted at one time together with the data of the transmission period value, the batch transmission data generation section 41O being connected with the transmission period value computing section 41G and the determination section 41M, and therefore reading the transmission period value and the data of elevator controllers or elevator cars to be group-controlled therefrom, respectively; and a data receiving/transmitting section 42K for transmitting, through the serial communication bus line, the set of data which is batch-transmitted from the batch transmission data generation section 410 to the elevator controllers.

Each elevator controller comprises a data receiving/transmitting section 42K for receiving the batch transmission data set from the data receiving/transmitting section 42K, and separating the transmission period value and the data of elevator controllers or elevator cars to be group-controlled from the batch transmission data, and outputting the separated one; a transmission period value memory section 42F for storing data of the transmission period value from the second data receiving/transmitting section 42K; a number of elevator car counter 42G for inducing the number of elevator cars to be group-controlled by receiving the data of the object to be group-controlled according to elevator controllers or elevator cars from the data receiving/transmitting section 42E; a number of elevator controllers memory section 42H for storing the number of elevator conctrollers to be group-controlled from the inducing counter;

an elevator controller number memory section 42I for storing the elevator controller number and being controlled by itself; a priority determination 42J for determining a priority by receiving the data of the object to be group-controlled, which is aligned in sequence in the order of increasing numbers of elevator controllers or elevator cars from the receiving/transmitting section 42E, by receiving the data of the present elevator controller number or present elevator car number from the elevator controller number memory section 42I, and by comparing the present elevator controller number or the present Elevator car number with the other elevator controller number or the other elevator car number, and if the other numbers is lower than the present numbers, generating and outputting output signals; a counter 42K for counting the number of elevator controllers having the priority to count the number of output signals from the priority determination 42J and to output the number of elevator controller or the elevator car having a higher priority; and a transmission waiting time calculating section 42L for calculating a transmission waiting time T2, which is obtained by the equation T2=T1/X×Y, wherein T1 is a transmission period value from the transmission period value memory section 42F, X is the number of elevator controllers or elevator cars from the number of elevator controllers memory section 42H, and Y is the number of the elevator controller or the elevator car having a higher priority, which received from the second counter of the number of the elevator controller having a higher priority.

Operations of the group controller 41 constituted as above are explained as follows: When power is supplied to the group controller 41, a data transmission period of each of elevator controllers 12A–12K is obtained by a routine of FIG. 5. Test SB1 determines if the group controller 41 is in executing an initialization. If test SB1 is affirmative, a communication period of an elevator controller is determined in step SB3. But, if it is negative, a test SB2 will be executed to determine if the number of elevator controllers connected with the group controller has changed. In this event, if test SB2 is negative, the process returns to test SB1, and if test SB1 is affirmative, it goes to the next step SB3.

In step SB3, in accordance with the number of elevator controllers connected with the group controller 41, the data transmission period T of each elevator controller is obtained by the following equation:

$$T=Y/X'\times X \tag{1}$$

wherein, Y is a minimum period it takes for the group controller to receive the data from all of the elevator controllers for a purpose of a preferable group control;

X is the number of elevator controllers connected at present with the group controller; and X' is the maximum number of elevator controllers which can be connected with the group controller.

Next, the serial number of the elevator controllers is determined as "1" by an initialization in step SB4. A test SB5 determines if the processes SB1–SB4 are executed with respect to all of elevator controllers 12A–12K. If test SB5 is negative, the process returns to test SB1.

However, if it is affirmative, indicating that the above processes SB1–SB4 for all elevator controllers 12A–12K are checked as being not ended, a determined data transmission period is transmitted to the corresponding elevator controller in step SB6.

Accordingly, the operation in execution is delayed as much as the delay in data transmission of each of the determined elevator controllers, and then, the number of the elevator controllers is increased by "1" to process the next messages of the next period in step SB8.

Figure 5:
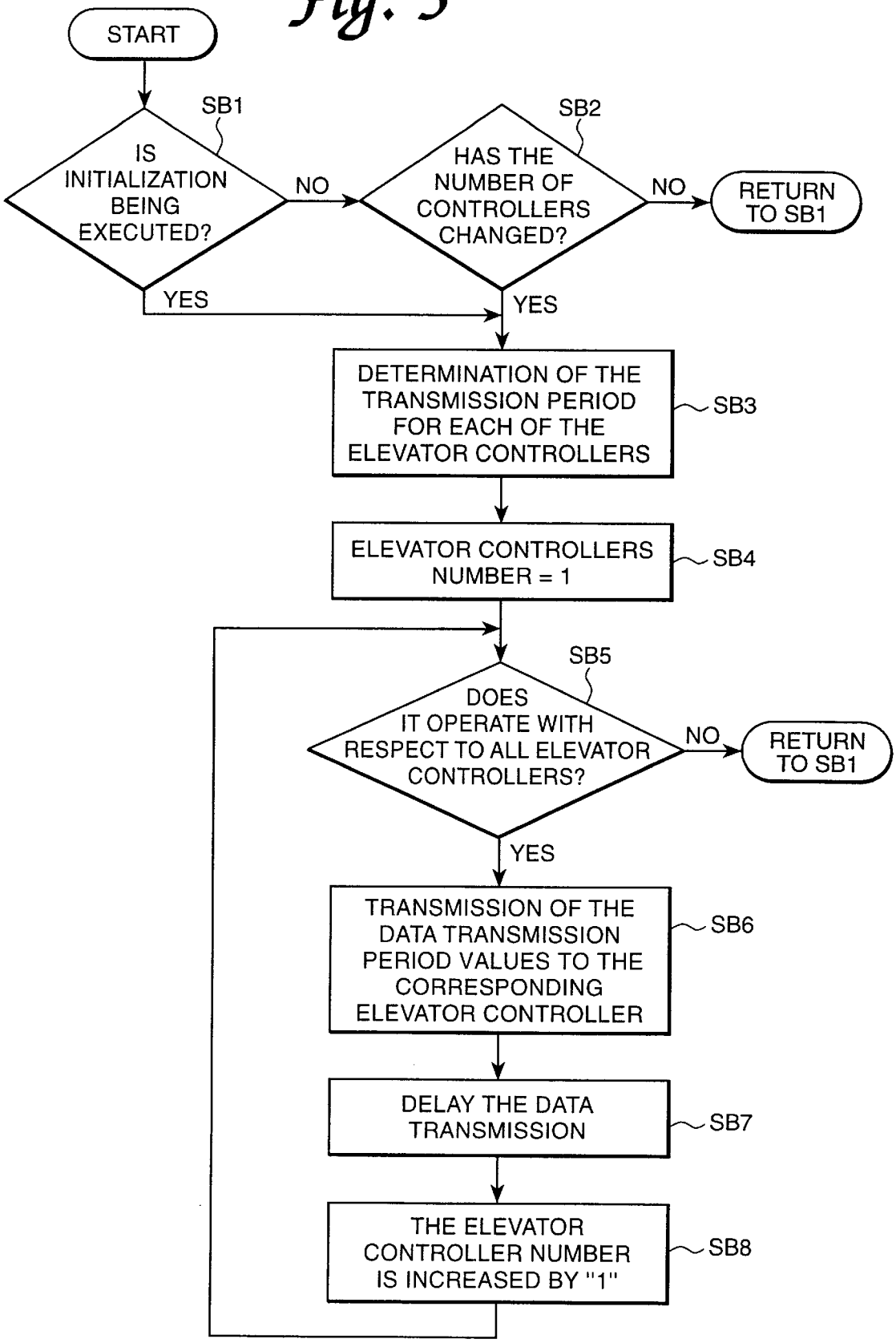
FIG. 5 is a flow chart showing the steps according to a method of the present invention, in which a group controller determines a data transmission period of each elevator controller, and the determined data transmission period is transmitted to each of elevator controllers.

As shown in FIG. 5, the data transmission period of each elevator controller is determined by the operations of step SB3 and step SB6, and an execution time is delayed by an operation of step SB7, so the point at which the data transmission of each elevator controller starts are dispersed.

For instance, if five elevator controllers 12A–12E are associated with the group controller 41, a minimum receiving period it takes for the group controller 41 to receive from all of the elevator cars 12A–12E is 80 ms, and if the number of elevator controllers being conductible with the group controller 41 is eight, the data transmission period of an elevator car is 80 ms/8×5=50 ms.

In accordance with the processes, a data transmission period is sequentially determined in the manner that after the first elevator car 12A determines a data transmission period as 50 ms and starts, the second elevator car 12B determines a period in which the data transmission starts after 10 ms. Therefore, since a data transmission period is determined as a whole as in FIG. 8, it is noted that the communication line does not take an excessive load when the elevator controllers use the serial communication bus line.

Figure 1:
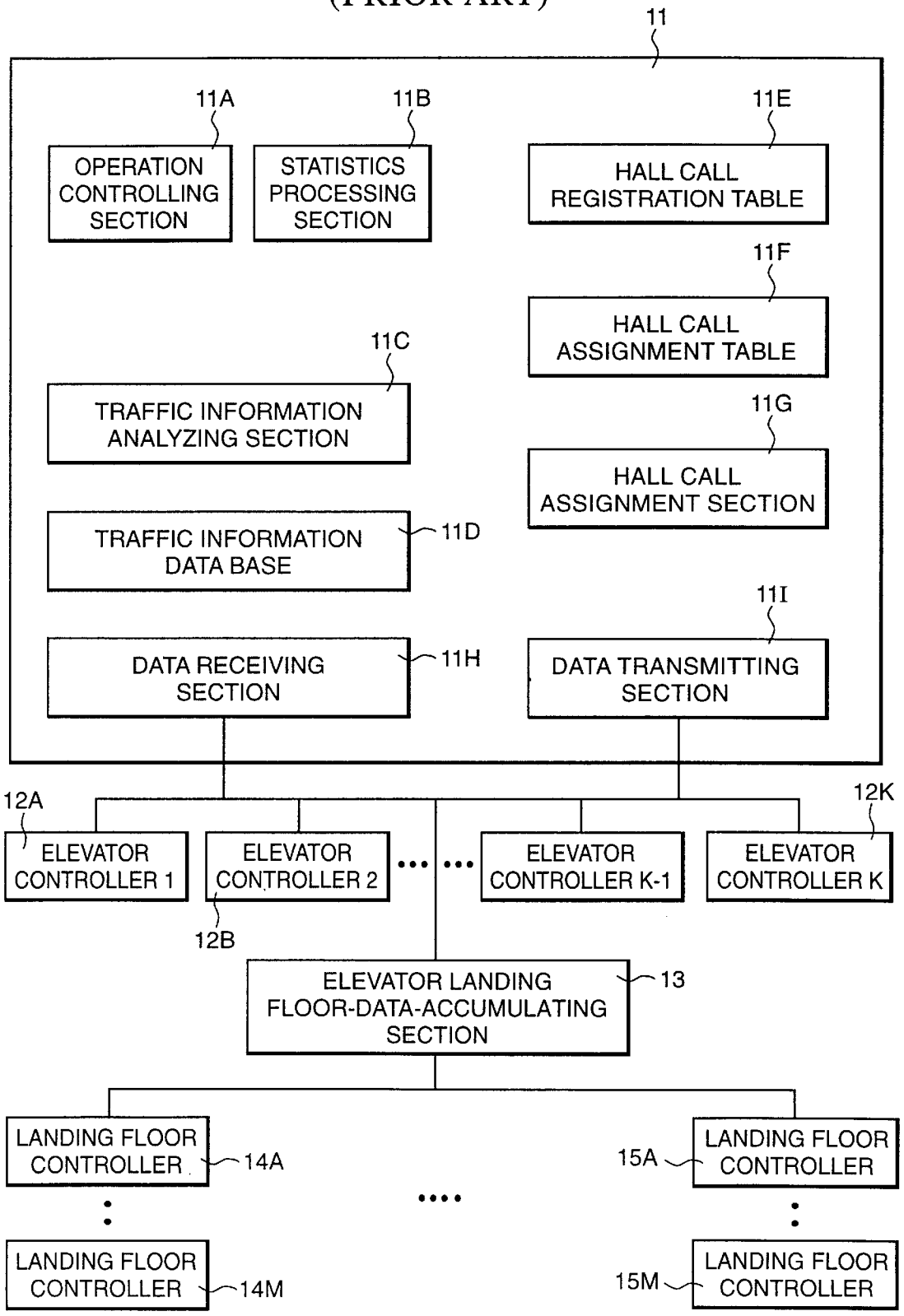
Fig. 1 (PRIOR ART)
FIG. 1 is a block diagram for a whole constitution of a group controller according to the conventional elevator group control apparatus.
Figure 2:
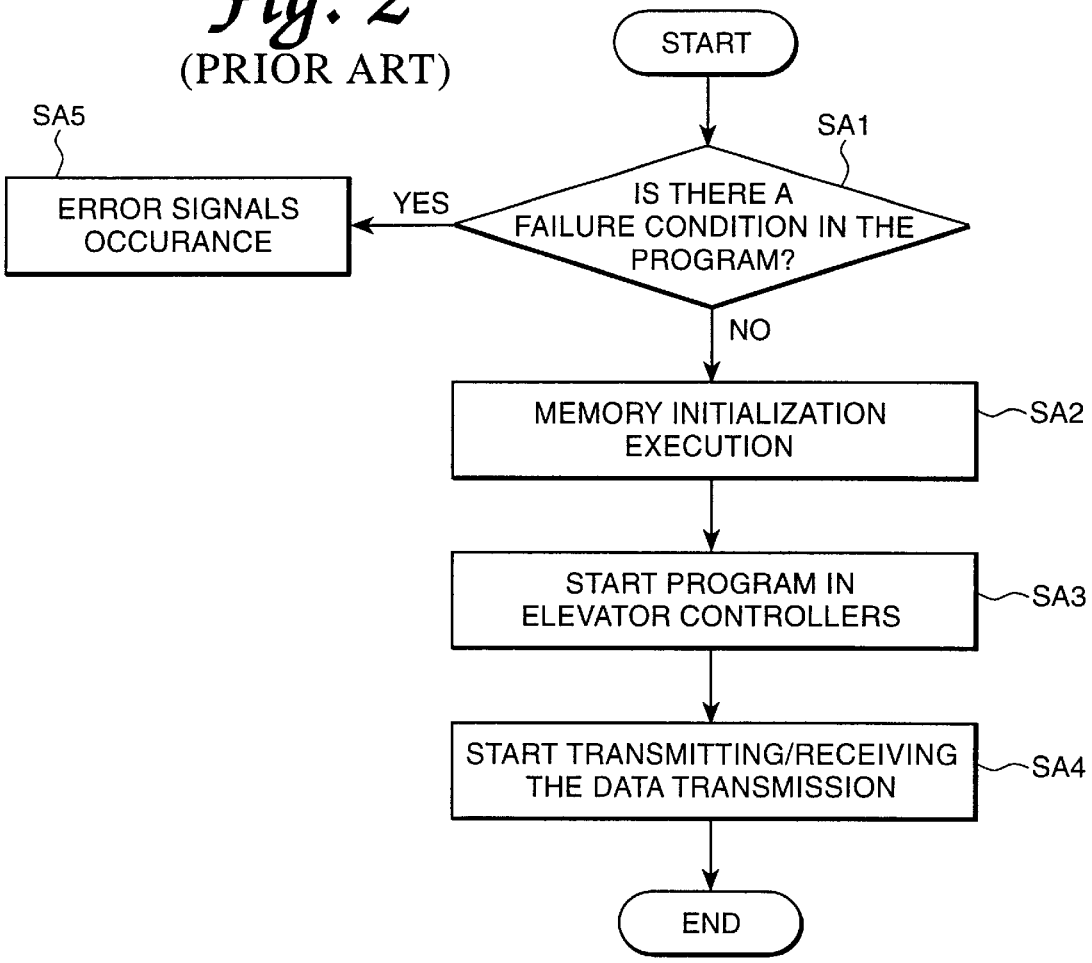
Fig. 2 (PRIOR ART)
FIG. 2 is a flow chart illustrating an initializing process when a data is transmitted/received to/in the conventional elevator group control apparatus.
Figure 3:
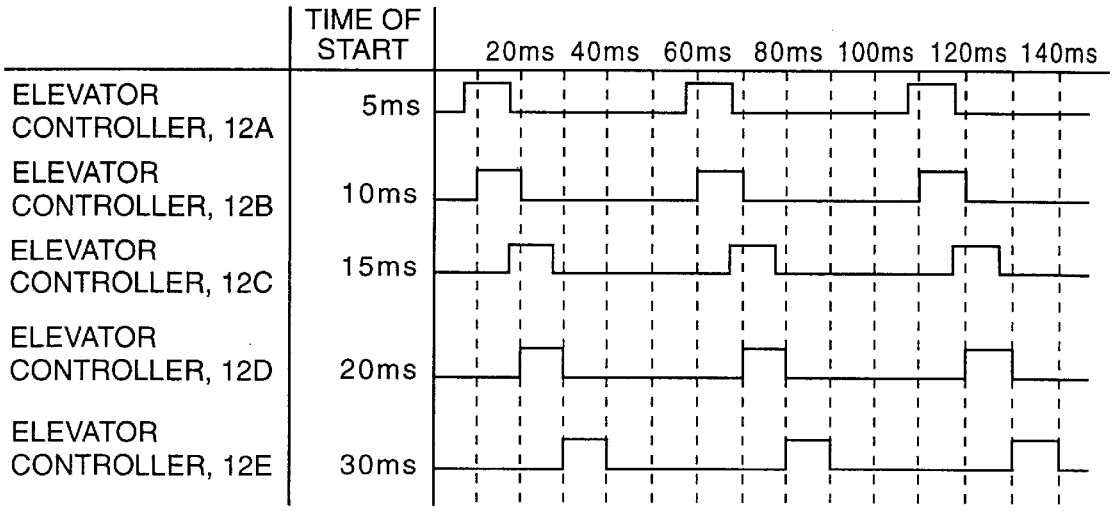
Fig. 3 (PRIOR ART)
FIG. 3 is a timing diagram for a messages transmission of the data created in the conventional elevator group control apparatus.
Figure 6:
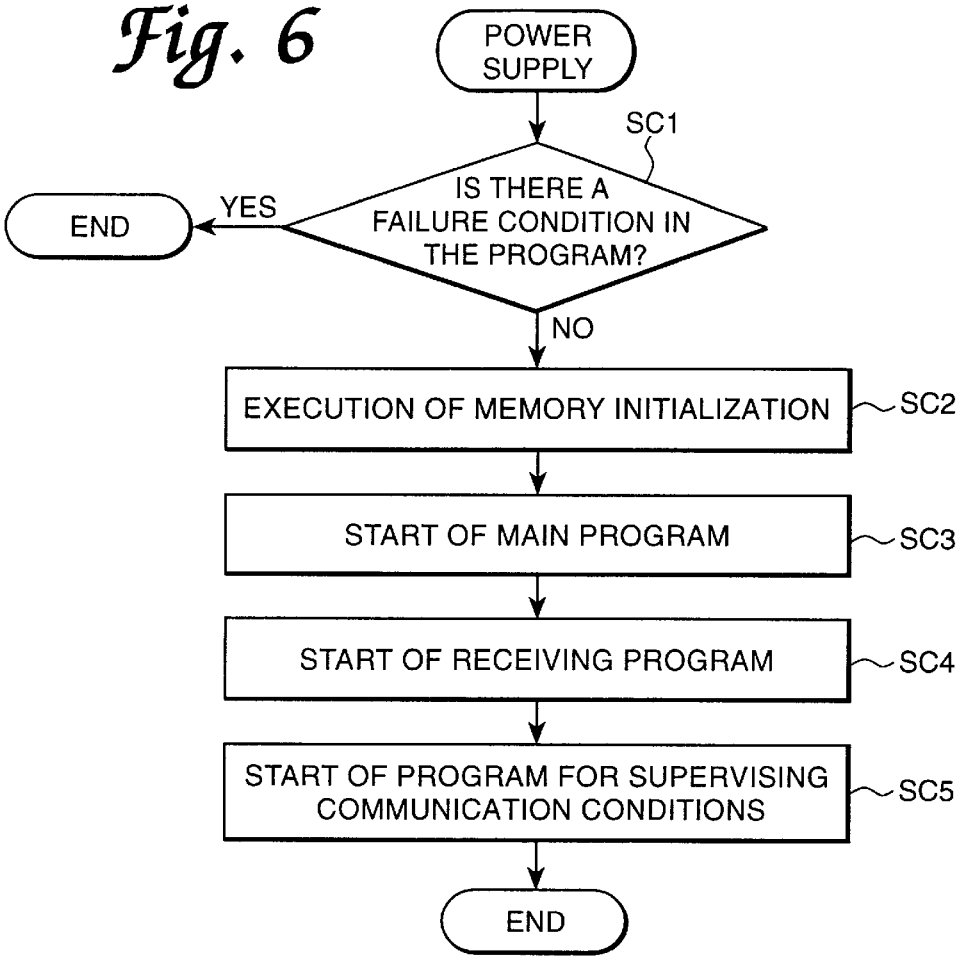
FIG. 6 is a flow chart showing an initializing process of the elevator controllers according to the method of the present invention.

Further, according to the above processes, if the elevator controllers are supplied with power before data are transmitted to the corresponding elevator controller, only a receiving program gets to be in starting operation because an initialization routine as in FIG. 6 has already started. The initialization routine of the elevator controllers shown in FIG. 6 and that of FIG. 2 according to the conventional technology are same with the exception that the steps in which the transmitting/receiving programs are started are changed to a step in which the receiving program is started in step SC4 and a step in which the program of supervising the communication conditions is started in step SC5.

When the group controller 41 transmits the data transmission period to the elevator controller, it is assured that the elevator controller is started since if it has not started, the elevator controller is not connected with the group controller 41 and therefore, the elevator controller is not included in the messages processes. In the elevator controller, the receiving program is started according to step SC4 of FIG. 6 to receive the data transmission period, and by progressing to step SC5, the program of supervising the communication conditions is started to execute operations after receiving the transmission period.

Figure 7:
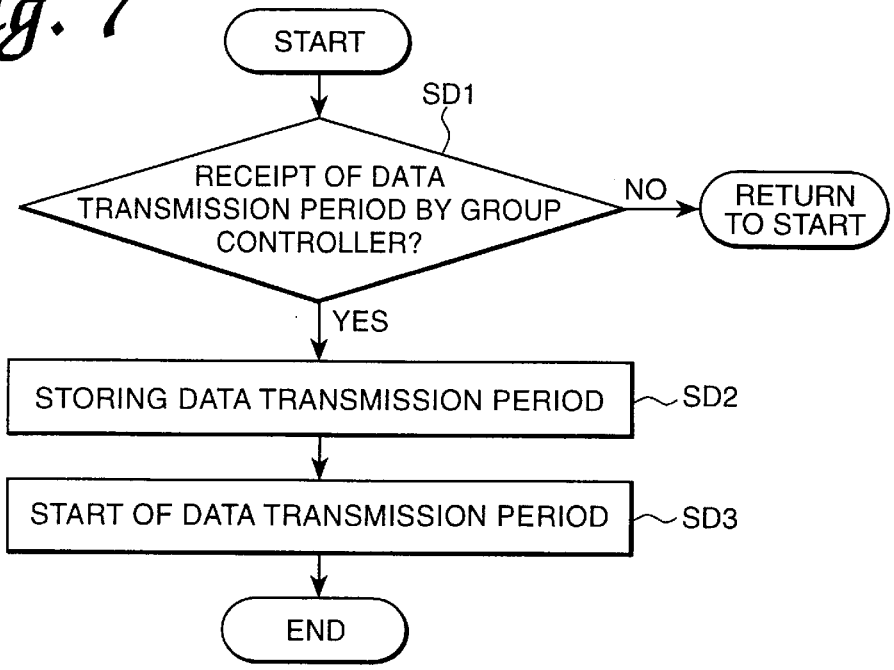
FIG. 7 is a detailed flow chart showing the step of determining a data transmission period from the group controller after a program for supervising the communication conditions shown in FIG. 6 and of starting the data transmission.

A process of starting the program of supervising the communication conditions is the same as the routine shown in FIG. 7.

After all, a test SD1 determines if, the data transmission period is received from the group controller 41. At this stage, if test SD1 is negative, the process returns to the previous test. However, if it is affirmative, the received data transmission period is determined as its data transmission period in step SD2 and the data transmission period is started in step SD3. At this time, the receiving program which has previously started is ended.

In case that there are no data to be transmitted by adjusting the data transmission period, a reliability of the communication data according to a dual transmitting can be secured by retransmitting the existing data which were transmitted. Additionally, a data transmitting speed is improved, for instance, if eight elevator controllers can transmit "1" unit data to the group controller 41 for 80 ms then and if the group controller 41 associated with five elevator cars, a data transmission period of an elevator controller is adjusted so that "1.6" unit data can be transmitted to the group controller 41. Consequently, the data transmitting speed from the elevator controller to the group controller 41 is greatly improved.

A method for adjusting the data transmission period and the start point in the elevator car as provided in the present invention can be variously changed in accordance with the formats for transmitting data from the group controller 41 to the elevator car.

The method for controlling the data transmission period and the start point in the elevator car as suggested above, for example, sends one by one from the group controller 41 to the elevator controllers, and from the elevator car 12A to the elevator car 12K by repeating an execution of the routine therebetween.

On the other hand, the other embodiment to be described later does not control the data transmission period and the start point as in FIG. 5 but it transmits the data in a batch processing as shown in FIG. 9.

A group controlling information as shown in FIG. 9 indicates whether the corresponding elevator car information is under each bit or not. For instance, if an optional one elevator car, for example, the second elevator car 12B is the group-control, "1" is determined in Bit 2, and if not entered, "0" is determined. And, for the data transmission period, it is used the period determined in the step of determining the communication period of the elevator car in FIG. 5.

When the data transmission period transmitted from the group controller 41 is received in the elevator controller, the corresponding elevator controller executes the data transmission process provided in FIG. 10 instead of FIG. 7, i.e., a batch transmitting process.

To explain the batch transmitting process with reference to FIG. 10, the elevator controllers determine the number of the elevator controllers to be connected with the group controller 41 after calculating the number of bits determined as "1" by analyzing the data transmitted in batch in step SE1. Consequently, among the elevator controllers prior to its own elevator controller, the number of elevator controllers which are previously under the group controller 41 is determined. For example, if the particular one is the fourth elevator controller, the number of bits as counted as "1" is set by searching Bits 1 for controllers, 2 and 3.

In step SE3, in consideration of the number of whole elevator controllers being group-controlled and the number of the elevator cars of which priority is higher than that of the particular one, a delay time T2 is determined by the following equation:

$$T2=T1/X\times Y \tag{2}$$

wherein, X is the number of elevator controllers to be group-controlled; Y is the number of elevator controllers having the highest priority than the particular one; and T1 is the data transmission period (extracted from batch transmitting data) to be executed.

In this case, the data transmission period of the elevator controller is calculated as T1/X. After waiting until the elevator controller having a higher priority than a particular controller is preferentially started, the present one starts its data transmission period, wherein a time error in receiving the data in each elevator controller is ignored.

For instance, if a data transmission period is 50 ms, the number and the number of elevator controllers being group-controlled is five(5), and the interval in starting the data transmission is 10 ms, then the five elevator cars obtain the following results: the first elevator car immediately starts; the second elevator car starts after 10 ms; the third elevator car after 20 ms; the fourth elevator car after 30 ms; and the fifth elevator car after 40 ms.

As in the above detailed description, the present invention has the acting effects of reducing the loads of the serial communication bus line; shortening the time required for elevator controllers to send data to the group controller by adjusting/controlling the data transmission period of the elevator controllers so that a non-used time among the usable time of the serial communication bus line assigned to the elevator controller is used; and securing a reliability of the data based on the dual transmitting way by retransmitting the data which are already transmitted when there are no data to be transmitted.

What is claimed is:

1. An apparatus for setting a data transmission period in an elevator group control system which includes a plurality of elevator controllers of which are each installed to correspond to each of elevator cars to control an operation of each elevator car, a group controller to receive an information data of operation conditions of the elevator cars from said elevator controllers and to control the operations of said elevator controllers in accordance with the received information data, and a common serial bus line which is linked with said elevator controllers to connect with said group controller, comprising:

a first means for setting the maximum number of elevator controllers which can be associated with the group controller at a maximum;

a first memory means for storing data of the maximum number of connectable elevator controllers set by said first means;

a second means for setting the number of elevator controllers to be controlled at present by the group controller;

a second memory means for storing data of the number of elevator controllers to be group-controlled, which are set by said second means;

a third means for setting a minimum period in which data of operation conditions are received from all elevator controllers periodically controlled by the group controller for a desirable control;

a third memory means for storing data of said minimum period in which data are received, and which are set by said third means;

a first computing means for computing a transmission period value and outputting a resulting value obtained by a data transmission period T (i.e., $T=Y/X'\times X$), wherein X' is a value of the maximum number of connectable elevator controllers, X is a value of the number of elevator controllers to be group-controlled, and Y is a value of the minimum period in which data are received, said first computing means being connected with said first, second and third memory means from which X', X and Y are read, respectively;

a second computing means for computing and outputting a delayed time in transmitting the transmission period value by dividing the value of the minimum period in which data are received by the value of the number of elevator controllers to be group-controlled, said second computing means being connected with said second and third memory means, and the value of the number of elevator controllers to be group-controlled and the value of the minimum period being read therefrom, respectively;

a transmission delay timer for outputting output signals when a delayed time is passed, by counting the transmission delay time received from said second computing means;

a generation and output means for generating and outputing an elevator controller number whenever said transmission delay timer outputs signals;

a first data receiving/transmitting section for transmitting, through the serial communication bus line, the value of the transmission period which is outputted from said first computing means and the elevator controller number from said generation means to the elevator controllers when said transmission delay timer outputs signals; and a counter for counting the transmission count of the transmission period value and for outputting a transmission stop signal to said first data receiving/transmitting section if the transmission count of transmission period value transmitted from said first data receiving/transmitting section is the same as the number of elevator controllers to be group controlled transmitted from said second memory means, said counter being connected with said first data receiving/transmitting section and said second memory means;

wherein each elevator controller comprises:

a second data receiving/transmitting section for receiving the transmission period value; and a fourth memory means for storing the received transmission period value.

2. An apparatus for setting a data transmission period in an elevator group control system which includes a plurality of elevator controllers of which are each installed to correspond to each of elevator cars to control an operation of each elevator car, a group controller to receive an information data of operation conditions of the elevator cars from said elevator controllers and to control the operations of said elevator controllers in accordance with the received information data, and a common serial bus line which is linked with said elevator controllers to connect with said group controller, comprising:

a first means for setting the maximum number of elevator controllers which can be associated with the group controller at a maximum;

a first memory means for storing data of the maximum number of connectable elevator controllers set by said first means;

a second means for setting the number of elevator controllers to be controlled at present by the group controller;

a second memory means for storing data of the number of elevator controllers to be group-controlled, which are set by said second means;

a third means for setting a minimum period in which data of operation conditions are received from all elevator controllers periodically controlled by the group controller for a desirable control;

a third memory means for storing data of said minimum period in which data are received, and which are set by said third means;

a first computing means for computing a transmission period value and outputting a resulting value obtained by a data transmission period T (i.e., $T=Y/X'\times X$), wherein X' is a value of the maximum number of connectable elevator controllers, X is a value of the number of elevator controllers to be group-controlled at present, and Y is a value of the minimum period in which data are received, said first computing means being connected with said first, second and third memory means from which X', X and Y are read, respectively;

a fourth means for setting whether each of elevator controllers set to be group-controlled or not;

a fourth memory means for storing the data set by said fourth means;

a batch transmission data generation means for aligning in serial the status data of group assoication for each of elevator controllers starting from the status data of elevator controllers having the lowerst number, and for outputting a set of the data to be transmitted at one time together with the data of the transmission period value, said batch transmission data generation means being connected with said first computing means and said fourth memory means, and therefore reading the transmission period value and the data of elevator controllers to be group-controlled therefrom, respectively; and a first data receiving/transmitting section for transmitting, through the serial communication bus line, the set of data which is batch-transmitted from said batch transmission data generation means to the elevator controllers;

wherein each elevator controller comprises:

a second data receiving/transmitting section for receiving the batch transmission data set from said first data receiving/transmitting section separating the transmission period value and the data of elevator controllers to be group-controlled from said batch transmission data, and outputting the separated one;

a fifth memory for storing data of the transmission period value from said second data receiving/transmitting section;

a first counter for inducing the number of elevator controllers to be group-controlled by receiving the data indicating the status of setting group association for each of elevator controllers from said second data receiving/transmitting section;

a sixth memory means for storing the number of elevator controllers to be group-controlled from said inducing counter;

a seventh memory means for storing its own elevator controller number;

a fifth means for determining a priority by receiving the data indicating the status of setting group association for each of the elevator controllers which is aligned serially from said second receiving/transmitting sections by receiving the data of its own elevator controller number from said seventh memory means, deducing elevator controller number from the status data aligned serially, and by comparing its own elevator controller number with the other elevator controller number deduced, and if either of the other numbers is lower than its own number, generating and outputting output signals;

a second counter for counting the number of elevator controllers having the priority by counting the number of output signals from said fifth determination means and to output the total number of elevator controller having the higher priority than its own elevator controller; and a second computing means for computing a transmission waiting time T2, which is obtained by the equation T2=T1/X×Y, wherein T1 is a transmission period value from said fifth memory means, X is the number of elevator controllers from said sixth memory means, and Y is the total number of the elevator controllers having the higher priority, which received from said second counter.

3. A method for setting a data transmission period in an elevator group control system which includes a plurality of elevator controllers which are each installed to correspond to each of elevator cars to control an operation of each elevator car, a group controller to receive an information data of operation conditions of the elevator cars from said elevator controller and to generally control the operations of said elevator controllers in accordance with the received information data, and a common serial communication bus line which is linked with said elevator controllers to connect with said group controller, comprising the steps of:

(a) transmitting, through the serial communication bus line, a data transmission period and a data transmission start point of each elevator controller, which are determined in accordance with the number of elevator cars connected with the serial communication bus line by the group controller, to the corresponding elevator controller; and (b) receiving the data transmission period and the start point which are transmitted through the serial communication line from the group controller; and (c) storing the data transmission period.

4. The method of claim 3, wherein said step of setting the data transmission period and transmitting it to an elevator controller comprises the steps of setting the data transmission period of an elevator controller by determining the number of elevator cars to be controlled by the group controller, of transmitting an information of said data transmission period one time to the corresponding elevator controller, of computing a constant delay time in accordance with the number of elevator controllers to be controlled by the group controller, and of delaying transmission of an information of the next data transmission period by as much as a delay time computed in a previous step, and then transmitting the information.

5. The method of claim 4, wherein said data transmission period (T1) of the elevator controller is obtained by the following equation:

$$T1=Y/X'\times X$$

wherein, Y is a minimum period that is needed for said group controller to receive the data from all of the elevator cars;

X is the number of elevator controllers connected with said group controller at present; and X' is a maximum number of elevator cars which can be connected with said group controller.

6. The method of claim 4, wherein said delay time (T2) of the elevator controller is obtained by the following equation:

$$T2=T1/X\times Y$$

wherein, X is the number of elevator controllers to be group-controlled at present; Y is the number of elevator controllers having higher priority than its own elevator controller, and T1 is the data transmission period.

7. The method of claim 3, wherein said data transmitted through the serial communication bus line to elevator controllers are information of a particular elevator controller or a plurality of elevator controllers.

8. The method of claim 3, wherein said step (b) comprises the steps of starting a data receiving program after a memory initialization is executed; checking whether a data indicating a data transmission period is received; setting a data transmission period according to said received data; and starting the data transmission.

* * * * *